US006105837A

United States Patent [19]

Teed

[11] Patent Number: 6,105,837

[45] **Date of Patent: *Aug. 22, 2000**

[54] WEARABLE ARTICLE CARRIER

[76] Inventor: Emily Teed, 31 Holland Ave., Peapack, N.J. 07977

[ * ] Notice: This patent issued on a continued prosecution application filed under 37 CFR 1.53(d), and is subject to the twenty year patent term provisions of 35 U.S.C. 154(a)(2).

[21] Appl. No.: 09/095,031

[22] Filed: Jun. 10, 1998

[51] Int. Cl.[7] ..... A45D 8/00

[52] U.S. Cl. ..... 224/181; 224/222; 224/665; 224/219; 132/273; 2/170; 2/171; 2/DIG. 11

[58] Field of Search ..... 224/219, 221, 224/222, 665, 605; 132/273, 275; 2/170, 59, 66, 171, DIG. 11

[56] References Cited

U.S. PATENT DOCUMENTS

| | | | |
|---|---|---|---|
| 1,552,420 | 9/1925 | Crippen, Jr. | 224/222 |
| 3,211,160 | 10/1965 | Miller . | |
| 3,611,444 | 10/1971 | Rector . | |
| 4,462,116 | 7/1984 | Sanzone et al. | 2/170 |
| 4,957,231 | 9/1990 | Kalisher | 224/901.8 |
| 5,054,127 | 10/1991 | Zevchak . | |
| 5,070,546 | 12/1991 | Stazo et al. . | |
| 5,104,016 | 4/1992 | Runkel . | |
| 5,230,452 | 7/1993 | Wagner . | |
| 5,413,126 | 5/1995 | Revson . | |
| 5,472,003 | 12/1995 | Frame et al. . | |

*Primary Examiner*—Linda J. Sholl
*Attorney, Agent, or Firm*—Mathews, Collins, Shepherd & Gould, P.A.

[57] ABSTRACT

A wearable carrier including a band that can be worn on the body of a user, and a pouch member detachably connected to the band. The pouch member includes at least one storage compartment for storing personal items of the user. The wearable carrier can be made in different sizes so that it can be attached to different parts of a user's body. This allows the wearable carrier to double, for example, as a hair-holding device or sweat band.

7 Claims, 2 Drawing Sheets

WEARABLE ARTICLE CARRIER

FIELD OF THE INVENTION

This invention relates to article carriers, and in particular, to a wearable article carrier for holding personal items such as jewelry, watches, money, and keys.

BACKGROUND OF THE INVENTION

Today's young women are active in various sports activities such as soccer, basketball, baseball, and field hockey. Organizers of such activities usually require wearable personal effects such as earrings, necklaces, bracelets, and watches, which are often worn by young women, to be removed during play for safety and insurance reasons.

Unfortunately, the uniforms worn during sports activities often fail to provide pockets for storing these personal items. It is not uncommon to see several players running to the sidelines, prior to the start of the activity, to hand over their jewelry, watches, and other personal items to parents, siblings, friends who are in attendance. When no one is available, the players often have to leave these items unattended on the ground next to the playing field or court where they are easily lost, stolen, or forgotten.

Accordingly, there is a need for a carrier which can store personal items such as jewelry, watches, money, and keys and be easily worn by the user during various activities.

SUMMARY OF THE INVENTION

A wearable carrier comprises a band that can be worn on the body of a user, and a pouch member detachably connected to the band. The pouch member includes at least one storage compartment for storing personal items of the user.

BRIEF DESCRIPTION OF THE DRAWINGS

The advantages, nature and various additional features of the invention will appear more fully upon consideration of the illustrative embodiments now to be described in detail in connection with the accompanying drawings. In the drawings.

It should be understood that the drawings are for purposes of illustrating the concepts of the invention and are not to scale.

DETAILED DESCRIPTION OF THE INVENTION

Figure 1A:
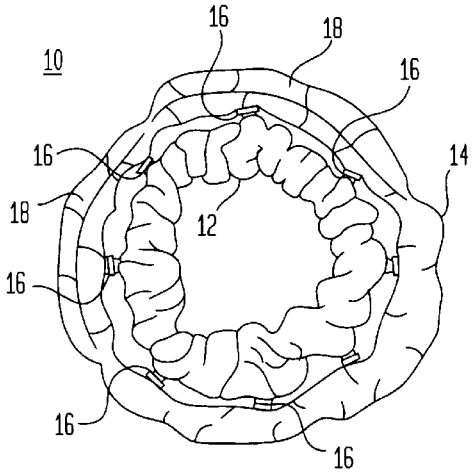
FIG. 1A is an elevational view showing a wearable carrier according to an exemplary embodiment of the present invention depicting the storage compartment openings in the closed position.
Figure 1B:
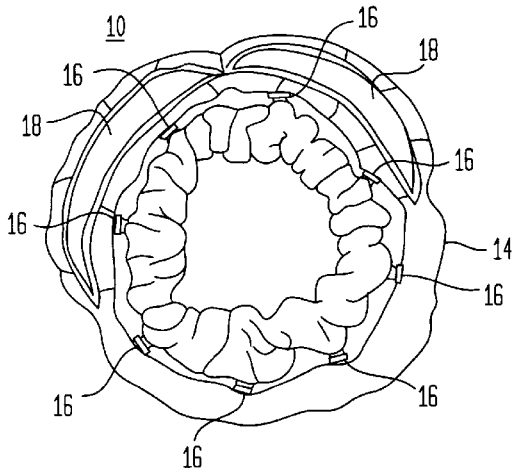
FIG. 1B is an elevational view showing the wearable carrier of FIG. 1A depicting the storage compartment openings in the open position.

FIGS. 1A and 1B show a wearable carrier 10 according to an exemplary embodiment of the present invention. The wearable carrier 10 comprises an elastically resilient inner band member 12 and an annular outer pouch member 14. The inner and outer members 12, 14 are detachably connected to one another by a plurality of spaced apart snap fastener assemblies 16. The outer pouch member 14 defines one or more closable item storage compartments 18 (the compartments 18 are shown closed in FIG. 1A. and open in FIG. 1B) for holding a user's personal items such as jewelry, watches, money, and keys to prevent their loss or theft. The wearable carrier 10 can be made in different sizes so that it can be attached to various parts of a user's body such as the user's waist, head, limb and hair. This allows the wearable carrier 10 to double, for example, as a hair-holding device or sweat band.

Figure 2:
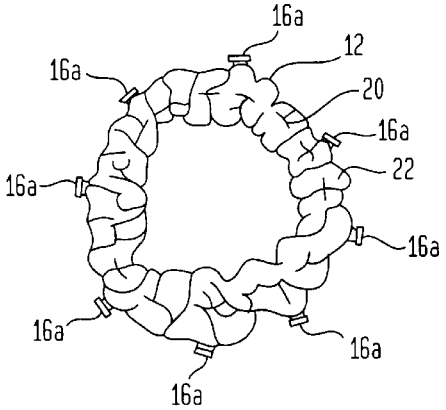
FIG. 2 is an elevational view showing the inner band member of the wearable carrier.

FIG. 2 shows the inner band member 12 of the wearable carrier 10 separated from the outer pouch member 14. The inner band member 12 comprises an ring-shaped elastic band 20 (shown with broken lines) surrounded by a tubular length of bunched fabric 22. A male or female member 16*a* of each of the snap fastener assemblies 16 is sewn or otherwise attached to the outer surface of the inner band member 12.

Figure 3:
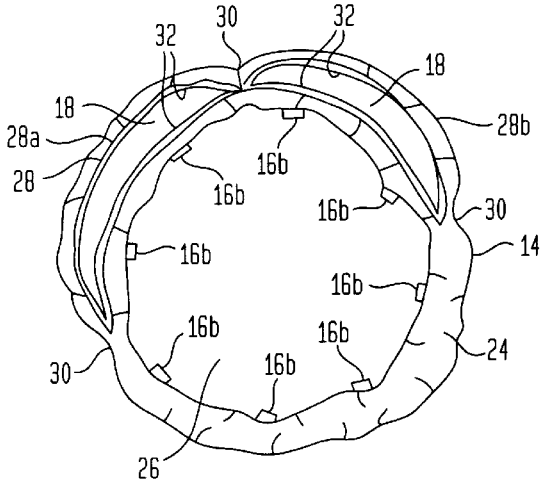
FIG. 3 is an elevational view showing the outer pouch member of the wearable carrier.

FIG. 3 shows the outer pouch member 14 of the wearable carrier 10 separated from the inner band member 12. The outer pouch member 14 comprises a tubular length of fabric 24 whose ends are sewn together thus defining a central aperture 26. A corresponding male or female member 16*b* of each of the snap fastener assemblies is sewn or otherwise attached to the inner surface of the central aperture 26. The central aperture 26 is sized to allow the inner band member 12 to be removably disposed therein. The compartments 18 can be fabricated by providing an elongated access opening 28 partially along the length of the fabric 24 and stitching radial line segments 30 of the fabric together to create two or more individual compartments 18 each having a corresponding access opening 28*a*, 28*b* as shown in the embodiment of FIG. 3. The access opening can also extend along the entire length of the fabric 24 so that compartments (each having a corresponding access opening) extend around the entire pouch member 14. The access openings 28*a*, 28*b* of the compartments 18 can be closed by hook and loop fastener assemblies 32. Other types of fastener arrangements such as zippers, snaps, and buttons can also be used for closing the access openings 28*a*, 28*b* of the compartments 18.

The inner band member 12 and outer pouch member 14 of the wearable carrier 10cany be fabricated with any style and form of fabric. The fabric can be solid or multi-colored and be decorated with various graphical designs and patterns.

In other exemplary embodiments of the present invention, the snap fastener assemblies 16 used for holding the inner and outer members 12, 14 of the wearable carrier 10 together can be replaced by hook and loop fasteners, buttons, a zipper, and other similar fastening arrangements.

Figure 4:
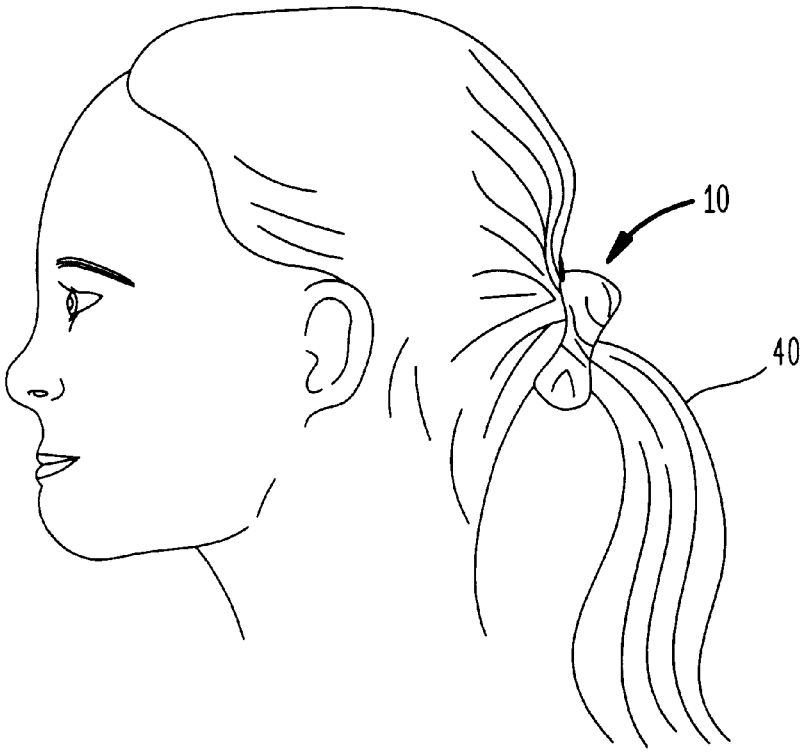
FIG. 4 is an elevational view showing the wearable carrier worn in a user's hair as a pony tail holder.

FIG. 4 shows the wearable carrier 10 worn in a user's hair as a pony tail holder. The flexible nature of the inner and outer members 12, 14 of the wearable carrier 10 allow it to be twisted and wrapped around the hair 40 of a user with personal items contained in the one or more compartments of the outer pouch member 14. The elastically resilient nature of the inner band member secures the wearable carrier 10 in the user's hair. The inner band member 12 can also be used alone to wrap or hold the user's hair (not shown) by separating the outer pouch member 14 therefrom via the snap fastener assemblies 16.

Figure 5:
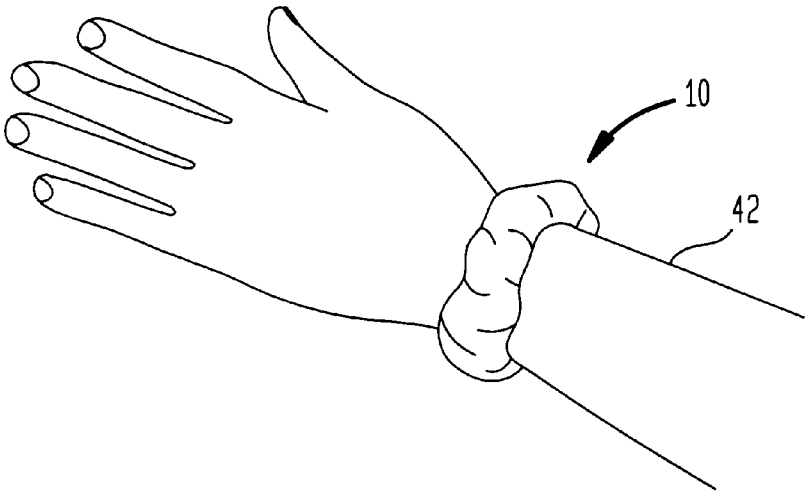
FIG. 5 is a perspective view showing the wearable carrier worn on a user's arm as a sweat band.

FIG. 5 shows the wearable carrier 10 worn on a user's arm as a sweat band. The elastically resilient nature of the inner band member 12 allows the wearable carrier 10 to conform and grip the user's wrist or arm 42. Although not shown, the wearable carrier 10 can also be sized so that it can be worn on a user's head as a sweat band, or around a user's waist.

It should be understood that the above described embodiments are illustrative of only a few of the many possible specific embodiments which can represent applications of the principles of the invention. Numerous and varied other arrangements can be devised by those skilled in the art without departing from the spirit and scope of the invention.

What is claimed is:

1. A wearable article carrier for holding items on a user's hair comprising:

an elastically resilient inner band member having a ring shape;

a plurality of first fastening means which are spaced apart from one another and attached at positions along an entire length of an outer surface of said inner band member;

an outer pouch member formed of a tubular length of fabric whose ends are coupled together to form a central aperture, said outer pouch member including at least one storage compartment having an elongated access opening at an outer surface of said tubular length of said outer pouch member and access opening fastening means for closing said access opening; and a plurality of second fastening means which are spaced apart from one another and attached at positions along an entire length of an inner surface of said central aperture of said outer pouch member;

said plurality of first fastening means being respectively coupled to ones of said plurality of second fastening means for concentrically disposing said entire length of said outer surface of said inner band member to said entire length of said inner surface of said central aperture of said outer pouch member, wherein said outer pouch member is attached to said inner band member when said band is secured to the user's hair to allow items to be contained in said compartment when said wearable article is secured to the user's hair.

2. The wearable carrier according to claim 1, wherein the at least one compartment comprises a plurality of compartments.

3. The wearable carrier according to claim 1, wherein the access opening fastening means is selected from a group consisting of hook and loop fasteners, snap fasteners, zippers, and buttons.

4. The wearable carrier according to claim 1, wherein the first fastening means and said second fastening means comprise a plurality of snap fastener assemblies.

5. The wearable carrier according to claim 1, wherein the fire fastening means and the second fastening means is selected from a group consisting of hook and loop fasteners, snap fasteners, zippers, and buttons.

6. The wearable carrier according to claim 1, wherein the inner band member and the outer pouch member are each fabricated from fabric.

7. The wearable carrier according to claim 6, wherein the fabric is selected from a group consisting of solid colored fabrics, multi-colored fabrics, fabrics with graphical designs, and fabrics with patterns.

* * * * *